US006979667B1

(12) United States Patent
Kaiser et al.

(10) Patent No.: US 6,979,667 B1
(45) Date of Patent: Dec. 27, 2005

(54) PERFUME COMPOSITIONS AND METHODS TO MASK AMINE MALODORS

(75) Inventors: Carl-Eric Kaiser, Mason, OH (US); Alan Scott Goldstein, Blue Ash, OH (US); Mark Leslie Kacher, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/936,399

(22) PCT Filed: Mar. 14, 2000

(86) PCT No.: PCT/US00/06606

§ 371 (c)(1),
(2), (4) Date: Sep. 11, 2001

(87) PCT Pub. No.: WO00/55288

PCT Pub. Date: Sep. 21, 2000

Related U.S. Application Data

(60) Provisional application No. 60/124,409, filed on Mar. 15, 1999.

(51) Int. Cl.[7] ..... C11D 3/50

(52) U.S. Cl. ..... 510/101

(58) Field of Search ..... 510/101

(56) References Cited

U.S. PATENT DOCUMENTS

| | | | | | |
|---|---|---|---|---|---|
| 5,500,154 | A | * | 3/1996 | Bacon et al. | 252/551 |
| 5,540,853 | A | * | 7/1996 | Trinh et al. | 510/101 |
| 5,780,404 | A | * | 7/1998 | Bacon et al. | 510/101 |

FOREIGN PATENT DOCUMENTS

| | | | |
|---|---|---|---|
| WO | WO 97/0623 A1 | | 2/1997 |
| WO | WO 98/07814 | * | 2/1998 |

* cited by examiner

*Primary Examiner*—John R. Hardee
(74) *Attorney, Agent, or Firm*—Kim W. Zerby; Steven W. Miller

(57) ABSTRACT

Disclosed are detergent compositions, particularly for manual dishwashing which, by incorporating a combination of anionic surfactants, solvents and certain selected perfume compositions that do not have the maladors associated with certain nitrogenous ingredients such as amines. Also disclosed are the perfume compositions themselves, characterised by 30% to 100% of an odor neutralizer capable of forming a Schiff base when reacted with an amine, said compositions having a pH of from 8.5 to 12.

7 Claims, No Drawings

PERFUME COMPOSITIONS AND METHODS TO MASK AMINE MALODORS

This application claims benefit of provisional application No. 60/124,409, file Mar. 15, 1999.

TECHNICAL FIELD

The present invention relates to detergent and cleaning compositions, particularly liquid or gel dishwashing compositions suitable for use in manual dishwashing operations. These detergent compositions contain anionic surfactants, solvents and perfume compositions which are specially selected to cover the malodors generated by nitrogenous compounds like amines. These components, in the combinations disclosed herein, provide dishwashing detergent compositions which have preferred food soil cleaning, handling and sudsing characteristics without the odors typically associated with amines. The present invention also relates to the perfume compositions themselves and methods for masking malodors.

BACKGROUND OF THE INVENTION

Light-duty liquid (LDL) or gel detergent compositions useful for manual dishwashing are well known in the art. Such products are generally formulated to provide a number of widely diverse performance and aesthetics properties and characteristics. First and foremost, liquid or gel dishwashing products must be formulated with types and amounts of surfactants and other cleaning adjuvants that will provide acceptable solubilization and removal of food soils, especially greasy soils, from dishware being cleaned with, or in aqueous solutions formed from such products. Thus, there is a continuing effort by formulators of liquid dishwashing compositions to incorporate additional components into LDL detergents to provide consumers with improved cleaning benefits.

Diamines are a type of nitrogenous compound which can improve the cleaning performance of liquid dishwashing detergent compositions, in particular the cleaning of greasy, hydrophobic soils on dishware or other kitchen articles. However, diamines can also cause extremely potent malodors, such as the unpleasant fragrance associated with permanent kits commonly used to curl hair.

Also, nitrogen-containing surfactants and polymers can provide both cleaning and sudsing advantages, but frequently contain amine impurities as by-products in commercial materials. When the composition exceeds the pKa of these amine impurities, the resultant free amine can be malodors. Consequently, it has been difficult to formulate a malodor-free light duty liquid at pH higher than 8.5.

Typically malodors associated with liquid dishwashing detergents are "masked" (covered up) by placing a perfume composition in the liquid dishwashing detergent, which when used in sufficient quantities, would mask the malodor emanating from the liquid detergent. These perfumes also provided the added benefit that a desirable fragrance, such as a lemon scent, could be imparted to the liquid detergent product.

However, some malodors cannot be masked simply by adding perfumes to the detergent. For example, when a particular malodor is highly volatile (and therefore diffuses quickly into the air) and/or when a particular malodor is extremely potent, it may be difficult to add a sufficient amount of perfume without giving the liquid dishwashing detergent a strong, perfumed odor. Given the foregoing there is a continuing need to formulate liquid dishwashing detergents that provide excellent cleaning benefits, but do not have malodors associated with them. Accordingly a benefit of the present invention is that a liquid dishwashing detergent is provided which incorporates certain nitrogen-containing components (e.g. diamines) which are capable of providing excellent cleaning performance but which is free of the malodors generally associated with the use of these components. The present invention also relates to a perfume compositions suitable for use in liquid dishwashing detergents.

The benefits of this invention can be provided for and included in a broader range of products than just LDLs. Such products include may liquid hand soap, shampoo, after shave, cologne and personal deodorants, other personal care compositions, hard surface cleaners and a variety of other home and personal care products in which nitrogenous compounds like amines may be present and it is desirable to mask any malodors that they may generate.

SUMMARY OF THE INVENTION

It has now been determined that a liquid dishwashing detergent containing nitrogenous compounds like amines can be prepared which provides excellent cleaning performance, particularly on greasy and hydrophobic soils, and includes a perfume composition which contains certain fragrance materials and odor neutralizers that are particularly effective at masking the malodors generated by nitrogenous compounds.

The detergent compositions according to the first aspect of the present invention comprise: (a) an anionic surfactant; (b) a solvent; (c) an amine having a pKa of greater than 8.0; and (d) a perfume composition comprising from about 30% to about 100% of an odor neutralizer which is capable of forming a Schiff base when reacted with an amine. The pH of the detergent composition (as measured as 10% aqueous solution) is from about 8.5 to about 12 and, in preferred embodiments, the mole ratio of said anionic surfactant to any amphoteric surfactant present to any diamine present is from about 100:40:1 to about 9:0.5:1.

In accordance with a second aspect of the present invention, a detergent composition suitable for use in hand dishwashing, said composition comprising: (a) from about 0.1% to about 5%, by weight of a diamine having a molecular weight less than or equal to 400 g/mol; (b) from about 5% to about 50%, by weight, of an anionic surfactant; (c) from about 0.5% to about 10%, by weight, of an amphoteric surfactant; (d) from about 0.1% to about 10.0%, by weight, of a buffering agent; (e) from about 0.1% to about 1.5%, by weight, of an alkali metal inorganic salt; and (f) from about about 0.75% to about 25.0%, by weight, of a solvent. The detergent composition also includes: (g) from about 0.01% to about 0.5%, by weight, of a perfume composition, comprising from about 30% to about 100% of an odor neutralizer which is capable of forming a Schiff base when reacted with a diamine. The pH (as measured as 10% aqueous solution) is from about 10.0 to about 12.0 and the mole ratio of said anionic surfactant to said amphoteric surfactant to said diamine is from about 27:8:1 to about 11:3:1.

The present invention also separately relates to a perfume composition suitable to mask diamine odors. The perfume composition comprises an organic material selected from the group consisting of fragrance materials having a boiling point of less than 180° C., odor neutralizers capable of forming a Schiff base when reacted with an amine and mixtures thereof.

All parts, percentages and ratios used herein are expressed as percent weight unless otherwise specified. All documents cited are, in relevant part, incorporated herein by reference.

DETAILED DESCRIPTION OF THE INVENTION

Definitions—The present detergent compositions comprise an "effective amount" or a "grease removal-improving amount" of individual components defined herein. By an "effective amount" of the diamines herein and adjunct ingredients herein is meant an amount which is sufficient to improve, either directionally or significantly at the 90% confidence level, the performance of the cleaning composition against at least some of the target soils and stains. Thus, in a composition whose targets include certain grease stains, the formulator will use sufficient diamine to at least directionally improve cleaning performance against such stains.

By "light-duty liquid (LDL) detergent composition" it is meant a detergent composition which is employed in manual (i.e. hand) dishwashing.

By "kitchen articles" it is meant cookware, flatware, dishes and dishware, silverware and other articles commonly found in the kitchen and used for the preparation, consumption and serving of food as well as those articles used for cleaning up at the conclusion of a meal or other food preparation.

By "nitrogenous compounds" it is meant those compounds containing nitrogen and related to ammonia or ammonium. Such compounds include amines, polyamines, amine oxide surfactants, amides, surfactants in which the hydrophilic, polar groups are neutralized by an ammounium cation, alkanolamine solvents (e.g. monoethanolamine, diethanolamine, and triethanolamine) and other similar compounds which are typically used in detergent or cleaning compositions.

By "malodor" it is meant any detectable odor associated with an amine or other nitrogenous compounds related to ammonia or ammonium.

By "amine" it is meant any derivative of ammonia or ammonium in which one or more of the hydrogen atoms is replaced by an alkyl group, a cyclic hydrocarbon group, a fatty alkyl group or an aromatic group.

By "scent" it is meant any detectable odor associated with and originating in a fragrance material.

By "volatility" it is meant the tendency of a liquid material to pass into the vapor state at a given temperature.

By "ethylene oxide group" it is meant the following structure:

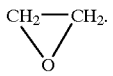

By "propylene oxide group" it is meant the following structure:

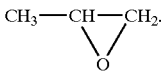

The present invention is directed to detergent and cleaning compositions, particularly liquid dishwashing detergent compositions, which include a perfume composition that is specially selected and formulated to mask the malodors generated by a broad array of nitrogenous compounds. These nitrogenous compounds can be added either intentionally to provide some performance benefit for the detergent or cleaning composition or may be introduced inadvertently as impurities in the surfactant additives (particularly in amine oxide, betaine and polyhydroxy fatty acid amide surfactants) and in amine-containing polymers.

The perfume compositions designed to mask these nitrogenous malodors comprise fragrance materials and odor neutralizers, which will now be set-forth in more detail below. The present detergent composition will comprise from about 0.01% to about 0.5%, preferably from about 0.02% to about 0.2%, most preferably from about 0.03% to about 0.08%, by weight of the perfume composition.

a) Fragrance Materials

The present perfume compositions contain fragrance materials which mask the presence of malodors emanating from amines and so allow the liquid dishwashing detergent to be free of amine malodors. These fragrance materials mask the amine malodors by providing scents which compete with the malodors for access to the nasal receptor sites.

Under typical usage conditions, malodors associated with amines and other such nitrogenous components of a dish detergent product are liberated from the dish detergent product as soon as the detergent is exposed to air (e.g. the bottle is opened and the product is then applied to a dish surface or diluted further with water). Generally such malodors will have accumulated in the headspace in the container between the different times that the consumers has used the detergent. Once the malodors are free of the detergent container, they diffuse into the surrounding air, move to the nasal receptor sites and provide an adverse olfactory signal which consumers instantly associate with the product.

While not intending to be limited by theory it is believed that the ability of fragrance materials contained in the present perfume compositions to mask malodors is related both to: 1) the amount of time that the scents emanating from the fragrances require to diffuse into the air and hence move from the detergent composition containers to the nasal receptor sites; and 2) the relative potency of a scent or malodor.

The rate at which a fragrance material diffuses into the air and hence escapes the detergent composition can also be related to its hydrophobicity, which is discussed in more detail below.

Thus the fragrance materials which constitute the perfume compositions of the present invention will be selected based on one or more of these three criteria: volatility, hydrophobicity and potency.

i) Volatility

An essential component of the perfume compositions of the present invention is a highly volatile fragrance material. Highly volatile fragrance materials have lower boiling points than other substances and so the scents from these materials quickly diffuse into the air, and compete with the malodors to bind to the nasal receptor sites, becoming the first odors recognized and identified by the brain. Because the scents form the highly volatile fragrance materials are more volatile and arrive before the amine malodors at the nasal receptor sites, when the amine malodors do finally arrive the nasal receptor sites have already been occupied thus effectively masking the recognition of the amine malodors.

The present perfume compositions may comprise from about 0.10% to about 4%, preferably from about 0.15% to about 2.5%, most preferably from about 0.20% to about 2.0%, of the highly volatile fragrance materials. Highly volatile fragrance material have a boiling point of below 180° C., preferably below 160° C., most preferably below about 140° C. under 1 atmosphere of pressure.

Most low molecular weight aldehydes, ketones, and esters have relatively high boiling points and are thus examples of highly volatile fragrance materials suitable for use in the present invention. Further nonlimiting examples of suitable highly volatile fragrance materials and their respective boiling point values under 1 atmosphere of pressure include the following:

| Fragrance Material | Boiling Point (° C.) |
|---|---|
| Methyl acetoacetate | 172 |
| Cyclohexyl alcohol | 161 |
| 3-Methyl-1-pentanol | 151 |
| 1,3-Dimethylbutyal acetate | 148 |
| Isopropyl 2-methylbutyrate | 138 |
| ethyl-2-methylbutyrate | 131 |

It is preferable that the present perfume compositions also constitute volatile fragrance materials. As used in this present invention, volatile fragrance materials are less volatile than the highly volatile fragrance materials and have a boiling point of between about 180° C. and about 260° C., more preferably between about 185° C. and about 240° C., most preferably between about 190° C. and about 220° C. under 1 atmosphere of pressure.

The perfume compositions of the present invention may comprise from about 30% to about 50%, preferably from about 35% to about 50%, most preferably from about 40% to about 45%, of volatile fragrance materials.

Because the perfume compositions of the present invention are more effective at masking amine malodors and other malodors originating in nitrogenous compounds when both highly volatile and volatile perfume compositions are present. As summarized above, the present perfume compositions effectively mask these malodors because they include highly-volatile fragrance materials, which arrive at the nasal receptor sites before the malodors, therefore effectively masking the malodors. However, it is possible that after sufficient time has passed and the malodors have arrived in the physical proximity of the nasal receptors sites, scents already resident in the sites may degrade or migrate out of them; thus giving the malodors an opportunity to bind with the sites and thereby making the odors perceptible to consumers. This is especially the case if there is a higher concentration of malodors or the malodors are more potent than the scents from highly volatile fragrance materials.

To prevent this, it is preferable to include fragrance materials in the perfume composition which are not as volatile as the highly volatile fragrance materials. The scents from these fragrance materials should arrive either simultaneously or soon after the malodors and compete with the malodors for the sites vacated as scents emitted by the highly volatile fragrance materials degrade or migrate out of the nasal receptor sites.

Nonlimiting examples of suitable volatile fragrance materials and their respective boiling point values under 1 atmosphere of pressure include the following:

| Fragrance Material | Boiling Point (° C.) |
|---|---|
| 3,7-dimethyl-1,6-octadien-3-ol | 198 |
| 3,7-dimethyl-7-hydroxyoctan-1-al | 241 |
| n-decyl aldehyde | 215 |
| benzaldehyde | 179 |
| anisic aldehyde | 248 |
| benzyl acetate | 215 |
| allyl hexanoate | 185 |
| methyl-2-aminobenzoate | 237 |
| 2-cis-3,7-dimethyl-2,6-octadien-1-ol | 227 |
| 3,7-dimethyl-trans-2,6-octadien-1-ol | 230 |
| 3,7-dimethyl-6-octen-1-ol | 225 |
| 2,6-dimethyl-7-octen-2-ol | 208 |
| 2-phenylethyl alcohol | 220 |
| 1-methyl-4-iso-propyl-1-cyclohexen-8-ol | 219 |
| 1-1-methyl-4-iso-propenyl-6-cyclohexen-2-one | 231 |
| para-tertiary-amyl cyclohexanone | 211 |
| cyclohexanyl 2-tertiary butyl acetate | 241 |
| benzyl acetate | 211 |

The boiling point of many perfume materials are disclosed in, e.g., "Perfume and Flavor Chemicals (Aroma Chemicals)," S. Arctander, published by the author, 1969, incorporated herein by reference. Other boiling point values can be obtained from different chemistry handbooks and databases, such as the Beilstein Handbook, Lange's Handbook of Chemistry, and the CRC Handbook of Chemistry and Physics. When a boiling point is given only at a different pressure, usually lower pressure than the normal pressure of one atmosphere, the boiling point at normal or ambient pressure can be approximately estimated by using boiling point-pressure nomographs, such as those given in "The Chemist's Companion," A. J. Gordon and R. A. Ford, John Wiley & Sons Publishers, 1972, pp. 30–36. When applicable, the boiling point values can also be calculated by computer programs, based on molecular structural data, such as those described in "Computer-Assisted Prediction of Normal Boiling Points of Pyrans and Pyrroles," D. T. Stanton et al, J. Chem. Inf. Comput. Sci., 32 (1992), pp. 306–316, "Computer-Assisted Prediction of Normal Boiling Points of Furans, Tetrahydrofurans, and Thiophenes," D. T. Stanton et al, J. Chem. Inf. Comput. Sci., 31 (1992), pp. 301–310, and references cited therein, and "Predicting Physical Properties from Molecular Structure," R. Murugan et al, Chemtech, June 1994, pp. 17–23. All the above publications are incorporated herein by reference.

ii) Hydrophobicity

Another important parameter of the fragrance materials used in the present invention is the degree of hydrophobicity. Liquid detergent compositions of the present invention may be heavily diluted, having formulas containing as much as 80% of water. Thus while the product is being stored, hydrophobic fragrance materials are more likely to concentrate themselves at the interface between the liquid detergent composition and the headspace in the detergent container (e.g. squeeze bottle) air located in the bottle in which the liquid dishwashing detergent is contained. When the product is used by a consumer, those fragrance materials which are more hydrophobic will be positioned on the liquid detergent-air interface and thus more readily evaporate into the air to provide pleasant fragrant signaling.

The degree of hydrophobicity of a fragrance material can be correlated with its octanol/water partitioning coefficient ("P"). The octanol/water partitioning coefficient of a fragrance material is the ratio between its equilibrium concentration in octanol and in water. A fragrance material with a greater partitioning coefficient P is more hydrophobic. Conversely, a fragrance material with a smaller partitioning coefficient P is more hydrophilic. The preferred fragrance materials of the present invention have an octanol/water partitioning coefficient P of 1000 or greater. Since the partitioning coefficients of the fragrance materials normally have high value, they are more conveniently given in the form of their logarithm to the base 10, log P.

The perfume compositions of the present invention may comprise from about 20% to about 70%, preferably from about 30% to about 60%, most preferably from about 40% to about 55% of fragrance materials which have ClogP values of greater than 2.5.

The logP of many perfume ingredients has been reported; for example, the Pomona92 database, available from Daylight Chemical Information Systems, Inc. (Daylog CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The ClogP values, which are the most reliable and widely used estimates for this physicochemical property, are used instead of the experimental logP values in the selection of perfume ingredients which are useful in the present invention.

Nonlimiting examples of suitable fragrance materials and their respective ClogP values include the following:

| Perfume Material | ClogP |
|---|---|
| Benzyl acetate | 2.0 |
| Ethyl-2-methylbutyrate | 2.2 |
| Furfuryl valerate | 2.7 |
| Isobutyl benzyl carbinol | 2.9 |
| para-Ethyl-alpha, alpha-dimethylHydrocinnamaldehyde | 3.4 |
| Isobutyl caproate | 3.8 |
| 4-tert.-butylcyclohexyl acetate | 4.1 |

iii) Potency

Potency refers to the perceptual intensity of a perfume material vs. the amount of fragrance material needed to achieve that intensity. Every fragrance material has unique psychophysical properties (they are not all equally strong), although generally, the fragrance materials with a lower boiling point are more potent than fragrance materials with a higher boiling point indicating that the potency of a substance is related to the quickness with which it evaporates and diffuses into the air to create a perceptible scent.

It is preferable that at least one of the fragrance materials used herein has a low-odor-detection threshold. As used in this present invention, low-odor-threshold fragrance materials have a odor detection threshold of less than 4.0 mg/L, preferably less than 1.0, more preferably less than 0.10 mg/L when the fragrance material is dissolved in a water matrix. The perfume composition of the present invention may comprise less than about 20%, preferably less than about 8%, most preferably less than about 0.08% of fragrance materials which have a low-odor-threshold.

Nonlimiting examples of suitable potent fragrance materials and their respective odor detection threshold values when the fragrance material is dissolved in a water matrix include the following:

| Perfume Material | Odor Detection Threshold (mg/L) |
|---|---|
| ethyl-2-methylbutyrate | $1 \times 10^{-4}$ |
| ethyl acrylate | 0.067 |
| dichloracetic acid | 0.232 |
| hexanoic acid | 3.000 |
| 4-tert.-butylcyclohexyl acetate | 3.500 |

The odor detection threshold of fragrance materials are well-known and disclosed in available reference materials, e.g., "Compilation of Odor and Taste Threshold Values Data," F. A. Fazzalari, ed., American Society for Testing and Materials, 1978.

The Determination of Odor Detection Thresholds

In order to determine the odor detection threshold, a gas chromatograph is characterized to determine the exact volume of material injected by the syringe, the precise split ratio, and the hydrocarbon response using a hydrocarbon standard of known concentration and chain-length distribution. The air-flow is accurately measured and, assuming the duration of a human inhalation to last 0.2 minutes, the sample volume is calculated. Since the precise concentration at the detector at any point in time is known, the mass per volume inhaled is known and hence the concentration of material. To determine whether a material has a threshold below 4 mg/L, solutions are delivered to the sniff port at the back-calculated concentration. A panelist sniffs the GC effluent and identifies the retention time when odor is noticed. The average over all panelists determines the threshold of detectability.

The necessary amount of fragrance material is injected onto the column to achieve a 4 mg/L concentration at the detector. Typical gas chromatograph parameters for determining odor detection thresholds are listed below.

GC: 5890 Series II with FID detector
7673 Autosampler
Column: J&W Scientific DB-1
Length 30 meters ID 0.25 mm film thickness 1 micron
Method:
Split Injection: 17/1 split ratio
Autosampler: 1.13 microliters per injection
Column Flow: 1.10 mL/minute
Air Flow: 345 mL/minute
Inlet Temp. 245° C.
Detector Temp. 285° C.
Temperature Information
Initial Temperature: 50° C.
Rate: SC/minute
Final Temperature: 280° C.
Final Time: 6 minutes
Leading assumptions: a) 0.02 minutes per sniff
b) GC air adds to sample dilution To determine whether a material has a threshold below 1.0 mg/L or 0.1 mg/L a sufficient amount of fragrance material is injected onto the column to achieve a 1.0 mg/L or 0.1 mg/L concentration at the detector.

b) Odor Neutralizers

Odor neutralizers work differently than the fragrance materials discussed above. They mask the malodors by depriving the malodors of access to the nasal receptor sites, but by reducing the amount of the amines generating the malodor. Any chemical species that upon reacting with an amines yields products which generate little or significantly less malodor than amines is suitable as an odor neutralizer. A preferred species of odor neutralizers are aldehydes; it is well known that aldehydes react with amines in a Schiff reaction to produce a Schiff base and water:

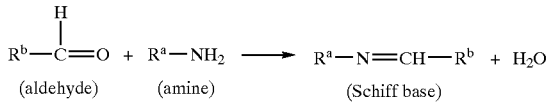

In the above reaction, $R^a$ and $R^b$ are both aliphatic substituents. In the present invention the amine may be a diamine included for the benefits it provides on tenacious, hydrophobic and greasy soils. See the discussion of diamines below.

Schiff bases generate little or no malodor and thus by reacting an aldehyde with a amine they reduce the amount of the amine which is present to generate malodors. Specific aldehydes suitable for use in the present invention include: para-tertiary-Butyl-alpha-methly hydrocinnamic aldehyde, 4-(4-Methyl-4-hydroxyamyl)-3-cyclohexane-1-Carboxaldehyde, 4-(4-Hydroxy-4-Methyl Pentyl), hydroxycitronellal, alpha-methyl-beta-3,4-methylenedioxy-phenylpropionaldehyde as well as most aldehydes. Many odor neutralizers, e.g. several different species of aldehydes, emit a characteristic scent and can also serve in the present invention as a fragrance material. From about 30% to about 100%, preferably from about 45% to about 65%, most preferably from about 50% to about 80%, of the perfume compositions of the present invention will consist of an odor neutralizer which is capable of forming a Schiff base when reacted with an aldehyde.

Diamines—As noted above, diamines may be used herein in detergent compositions in combination with detersive surfactants at levels which are effective for achieving at least a directional improvement in cleaning performance. In the context of a hand dishwashing composition, such "usage levels" can vary depending not only on the type and severity of the soils and stains, but also on the wash water temperature, the volume of wash water and the length of time the dishware is contacted with the wash water.

Since the habits and practices of the users of detergent compositions show considerable variation, the composition will preferably contain at least about 0.1%, more preferably at least about 0.2%, even more preferably, at least about 0.25%, even more preferably still, at least about 0.5% by weight of said composition of diamine. The composition will also preferably contain no more than about 15%, more preferably no more than about 10%, even more preferably, no more than about 6%, even more preferably, no more than about 5%, even more preferably still, no more than about 1.5% by weight of said composition of diamine.

In one of its several aspects, this invention provides a means for enhancing the removal of greasy/oily soils by combining the specific diamines of this invention with surfactants. Greasy/oily "everyday" soils are a mixture of triglycerides, lipids, complex polysaccharides, fatty acids, inorganic salts and proteinaceous matter.

Thus diamines, in combination with amphoteric and anionic surfactants in the specific ratios discussed below, offer the benefit of improved grease and tough food cleaning which allows the elimination or reduction in the amount of divalent ions in the preferred embodiments of the present formula. This improved cleaning is a result of diamines' proclivity as a buffering agent to increase the alkalinity of the dishwashing composition. The superior rate of dissolution achieved by divalent ion elimination even allows the formulator to make hand dishwashing detergents, especially compact formulations, at even significantly higher viscosities (e.g., 1,000 centipoise or higher) than conventional formulations while maintaining excellent dissolution and cleaning performance. This has significant potential advantages for making compact products with a higher viscosity while maintaining acceptable dissolution. By "compact" or "Ultra" is meant detergent formulations with reduced levels of water compared to conventional liquid detergents. For "compact" or "Ultra" formulations, the level of water is less than 50%, preferably less than 30% by weight of the liquid dishwashing detergent compositions. Said concentrated products provide advantages to the consumer, who has a product which can be used in lower amounts and to the producer, who has lower shipping costs. For compositions which are not meant to be concentrated, a suitable water level is less than about 85%, more preferably less than about 70% by weight of the liquid dishwashing detergent compositions.

It is preferred that the diamines used in the present invention are substantially free from impurities. That is, by "substantially free" it is meant that the diamines are over 95% pure, i.e., preferably 97%, more preferably 99%, still more preferably 99.5%, free of impurities. Examples of impurities which may be present in commercially supplied diamines include 2-Methyl-1,3-diaminobutane and alkylhydropyrimidine. Further, it is believed that the diamines should be free of oxidation reactants to avoid diamine degradation and ammonia formation.

It is important that the liquid dishwashing detergent compositions of the present invention be as free of hydrogen peroxide as possible. This is because it is believed that the malodors traditionally associated with diamine-containing consumers products are emitted by of the nitrogen compounds produced in a reaction between diamine and peroxide. Therefore, it is preferred to minimize the amount of hydrogen peroxide present as an impurity in the inventive compositions either by using components which are substantially free of hydrogen peroxide.

Preferred organic diamines are those in which pK1 and pK2 are in the range of about 8.0 to about 11.5, preferably in the range of about 8.4 to about 11, even more preferably from about 8.6 to about 10.75. Preferred materials for performance and supply considerations are 1,3-bis(methylamine)-cyclohexane (pKa=10 to 10.5), 1,3 propane diamine (pK1=10.5; pK2=8.8), 1,6 hexane diamine (pK1=11; pK2=10), 1,3 pentane diamine (Dytek EP) (pK1=10.5; pK2=8.9), 2-methyl 1,5 pentane diamine (Dytek A) (pK1=11.2; pK2=10.0). Other preferred materials are the primary/primary diamines with alkylene spacers ranging from C4 to C8. In general, it is believed that primary diamines are preferred over secondary and tertiary diamines.

Definition of pK1 and pK2—As used herein, "pKa1" and "pKa2" are quantities of a type collectively known to those skilled in the art as "pKa" pKa is used herein in the same manner as is commonly known to people skilled in the art of chemistry. Values referenced herein can be obtained from literature, such as from "Critical Stability Constants: Volume 2, Amines" by Smith and Martel, Plenum Press, NY and London, 1975. Additional information on pKa's can be obtained from relevant company literature, such as information supplied by Dupont, a supplier of diamines.

As a working definition herein, the pKa of the diamines is specified in an all-aqueous solution at 25° C. and for an ionic strength between 0.1 to 0.5 M. The pKa is an equilibrium constant which can change with temperature and ionic strength; thus, values reported in the literature are sometimes not in agreement depending on the measurement method and conditions. To eliminate ambiguity, the relevant conditions and/or references used for pKa's of this invention are as defined herein or in "Critical Stability Constants: Volume 2, Amines". One typical method of measurement is the potentiometric titration of the acid with sodium hydroxide and determination of the pKa by suitable methods as described and referenced in "The Chemist's Ready Reference Handbook" by Shugar and Dean, McGraw Hill, N.Y., 1990.

It has been determined that substituents and structural modifications that lower pK1 and pK2 to below about 8.0 are undesirable and cause losses in performance. This can include substitutions that lead to ethoxylated diamines, hydroxy ethyl substituted diamines, diamines with oxygen in the beta (and less so gamma) position to the nitrogen in the spacer group (e.g., Jeffamine EDR 148). In addition, materials based on ethylene diamine are unsuitable.

The diamines useful herein can be defined by the following structure:

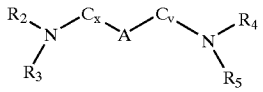

wherein $R_{2-5}$ are independently selected from H, methyl, —$CH_3CH_2$, and ethylene oxides; $C_x$ and $C_y$ are independently selected from methylene groups or branched alkyl groups where x+y is from about 3 to about 6; and A is optionally present and is selected from electron donating or withdrawing moieties chosen to adjust the diamine pKa's to the desired range. If A is present, then x and y must both be 1 or greater.

Examples of preferred diamines can be found in the copending provisional patent Application of Phillip Kyle Vinson et al., entitled "Dishwashing Detergent Compositions Containing Organic Diamines for Improved Grease Cleaning, Sudsing, Low Temperature Stability and Dissolution", having P & G Case No. 7167P, application Ser. No. 60/087,693, and filed on Jun. 2, 1998, which is hereby incorporated by reference.

Anionic Surfactants—The anionic surfactants useful in the present invention are preferably selected from the group consisting of linear alkylbenzene sulfonate, alpha olefin sulfonate, paraffin sulfonates, alkyl ester sulfonates, alkyl sulfates, alkyl alkoxy sulfate, alkyl sulfonates, alkyl alkoxy carboxylate, alkyl alkoxylated sulfates, sarcosinates, taurinates, and mixtures thereof. An effective amount, typically from about 0.5% to about 90%, preferably about 5% to about 50%, more preferably from about 10 to about 30%, by weight of anionic detersive surfactant can be used in the present invention.

Suitable examples of anionic surfactants may be found in copending provisional patent application of Chandrika Kasturi et al., entitled "Liquid Detergent Compositions Comprising Polymeric Suds Enhancers", having P & G Case No. 6938P, Ser. No. 60/066,344 and filed on Nov. 21, 1997, which is hereby incorporated by reference. Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23. Suitable anionic surfactants may further be found in U.S. Pat. No. 5,415,814 issued 16 May 1995, to Ofosu-Asante et al., all of which are hereby incorporated by reference.

Amphoteric surfactants—The amphoteric surfactants useful in the present invention are preferably selected from amine oxide surfactants. Amine oxides are semi-polar surfactants and include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar detergent surfactants include the amine oxide surfactants having the formula

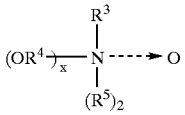

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{1-8}$ alkyl dimethyl amine oxides and $C_8$–$C_{12}$ alkoxy ethyl dihydroxy ethyl amine oxides.

Further amphoteric surfactants, and amine oxides in particular, are disclosed in the copending provisional application of Joanna M. Clarke entitled "Diols and Polymeric Glycols for Improved Dishwashing Detergent Compositions", having P & G Case No. 7408P and application Ser. No. 60/119,044, which is hereby incorporated in its entirety, by reference. Particular suitable for use herein, because they are low-foaming, it may be desirable to use long chain amine oxide surfactants which are more fully described in U.S. Pat. Nos. 4,316,824 (Pancheri), 5,075,501 and 5,071,594, incorporated herein by reference.

Preferably the amphoteric surfactant is present in the composition in an effective amount, more preferably from about 0.1% to about 20%, even more preferably about 0.1% to about 15%, even more preferably still from about 0.5% to about 10% by weight.

Secondary Surfactants—Secondary detersive surfactant can be selected from the group consisting of nonionics, cationics, ampholytics, zwitterionics, and mixtures thereof. By selecting the type and amount of detersive surfactant, along with other adjunct ingredients disclosed herein, the present detergent compositions can be formulated to be used in the context of laundry cleaning or in other different cleaning applications, particularly including dishwashing. The particular surfactants used can therefore vary widely depending upon the particular end-use envisioned. Suitable secondary surfactants are described in detail in the copending provisional patent application of Chandrika Kasturi et al., entitled "Liquid Detergent Compositions Comprising Polymeric Suds Enhancers", having P & G Case No. 6938P, application Ser. No. 60/066,344, incorporated above.

Ratio of Anionic to Amphoteric to Diamine

In the compositions of the present invention the ratio of the anionic surfactant: amphoteric: diamine is from about 100:40:1 to about 9:0.5:1, by mole, preferably the ratio of the anionic surfactant: amphoteric: diamine is from about 27:8:1 to about 11:3:1, by mole. It has been found that detergent compositions containing anionic surfactant, amphoteric surfactant and diamine in this specific ratio range provide improved low temperature stability, deliver better grease removal and tough food cleaning benefits at pH less than 12.5, and improved hard water cleaning.

In another aspect of the present invention the mole ratio of anionic surfactant to diamine of greater than 9:1, preferably greater than 20:1, has been found to give improved low temperature stability, deliver better grease removal and tough food cleaning benefits and improved hard water cleaning.

Solvents—A variety of water-miscible liquids such as lower alkanols, diols, polyols, ethers, amines and polymeric glycols which comprise ethylene oxide (EO) and propylene oxide (PO) groups and the like may be used in the present invention. Particularly preferred are the C1–C4 alkanols, diols and the above mentioned polymeric glycols.

When present the composition will preferably contain at least about 0.01%, more preferably at least about 0.5%, even more preferably still, at least about 1% by weight of the composition of solvent. The composition will also preferably contain no more than about 20%, more preferably no more than about 10%, even more preferably, no more than about 8% by weight of the composition of solvent.

These solvents may be used in conjunction with an aqueous liquid carrier, such as water, or they may be used without any aqueous liquid carrier being present. Solvents are broadly defined as compounds that are liquid at temperatures of 20° C.–25° C. and which are not considered to be surfactants. One of the distinguishing features is that solvents tend to exist as discrete entities rather than as broad mixtures of compounds. Examples of suitable solvents for the present invention include ethanol, propanol, propylene glycol, polypropylene glycol and isopropanol, 2-methylpyrrolidinone, benzyl alcohol and morpholine n-oxide. Preferred among these solvents are ethanol and isopropanol.

Suitable diols which can be used herein are according to the formula:

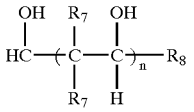

wherein n=0–3, $R_7$=H, methyl or ethyl; and $R_8$=H, methyl, ethyl, propyl, isopropyl, butyl and isoubutyl. Preferred diols include propylene glycol, 1,2 hexanediol, 2-ethyl-1,3-hexanediol and 2,2,4-trimethyl-1,3-pentanediol. When diols are present, the present compositions will comprise at least about 0.5%, more preferably at least about 1%, even more preferably still, at least about 3% by weight of the composition of diols. The composition will also preferably contain no more than about 20%, more preferably no more than about 10%, even more preferably, no more than about 6% by weight of the composition of diols.

Polymeric glycols are also suitable for use in the present invention. A preferred polymeric glycol is a polyproylene glycol having an average molecular weight of between about 1000 to about 5000, more preferably between about 2000 to about 4000, most preferably about 2000 to about 3000. Further examples of suitable polymeric glycols as well as their acceptable concentrations for use in a LDL compositions are disclosed in the copending provisional application of Joanna M. Clarke entitled "Diols and Polymeric Glycols for Improved Dishwashing Detergent Compositions", having P & G Case No. 7408P and application Ser. No. 60/119,044, which is hereby incorporated in its entirety, by reference.

Suitable solvents for use herein also include ethers and diethers having from 4 to 14 carbon atoms, preferably from 6 to 12 carbon atoms, and more preferably from 8 to 10 carbon atoms. Also other suitable solvents are glycols or alkoxylated glycols, alkoxylated aromatic alcohols, aromatic alcohols, aliphatic branched alcohols, alkoxylated aliphatic branched alcohols, alkoxylated linear C1–C5 alcohols, linear C1–C5 alcohols, C8–C14 alkyl and cycloalkyl hydrocarbons and halohydrocarbons, C6–C16 glycol ethers and mixtures thereof.

Besides propylene glycol, polypropylene glycol and the diols illustrated above, other glycols according to the formula: HO—CR1R2—OH wherein R1 and R2 are independently H or a C2–C10 saturated or unsaturated aliphatic hydrocarbon chain and/or cyclic are suitable and can be used herein. One such suitable glycol is dodecaneglycol.

Suitable alkoxylated glycols which can be used herein are according to the formula $$R—(A)_n—R^1—OH$$

wherein R is H, OH, a linear saturated or unsaturated alkyl of from 1 to 20 carbon atoms, preferably from 2 to 15 and more preferably from 2 to 10, wherein $R^1$ is H or a linear saturated or unsaturated alkyl of from 1 to 20 carbon atoms, preferably from 2 to 15 and more preferably from 2 to 10, and A is an alkoxy group preferably ethoxy, methoxy, and/or propoxy and n is from 1 to 5, preferably 1 to 2. Suitable alkoxylated glycols to be used herein are methoxy octadecanol and/or ethoxyethoxyethanol.

Suitable aromatic alcohols which can be used herein are according to the formula R—OH wherein R is an alkyl substituted or non-alkyl substituted aryl group of from 1 to 20 carbon atoms, preferably from 1 to 15 and more preferably from 1 to 10. For example a suitable aromatic alcohol to be used herein is benzyl alcohol.

The present invention may also include alkanolamine solvents (e.g. monoethanolamine, diethanolamine, and triethanolamine) which may also be included in the present invention as antioxidants.

Suitable aliphatic branched alcohols which can be used herein are according to the formula R—OH wherein R is a branched saturated or unsaturated alkyl group of from 1 to 20 carbon atoms, preferably from 2 to 15 and more preferably from 5 to 12. Particularly suitable aliphatic branched alcohols to be used herein include 2-ethylbutanol and/or 2-methylbutanol.

Suitable alkoxylated aliphatic branched alcohols which can be used herein are according to the formula R (A)n—OH wherein R is a branched saturated or unsaturated alkyl group of from 1 to 20 carbon atoms, preferably from 2 to 15 and more preferably from 5 to 12, wherein A is an alkoxy group preferably butoxy, propoxy and/or ethoxy, and n is an integer of from 1 to 5, preferably 1 to 2. Suitable alkoxylated aliphatic branched alcohols include 1-methylpropoxyethanol and/or 2-methylbutoxyethanol.

Suitable linear C1–C5 alcohols which can be used herein are according to the formula R—OH wherein R is a linear saturated or unsaturated alkyl group of from 1 to 5 carbon atoms, preferably from 2 to 4. Suitable linear $C_1$–$C_5$ alcohols are methanol, ethanol, propanol or mixtures thereof.

Further examples of suitable solvents for use herein may be found in the copending provisional patent application of Chandrika Kasturi et al., entitled "Liquid Detergent Compositions Comprising Polymeric Suds Enhancers", having P & G Case No. 6938P, Ser. No. 60/066,344 and filed on Nov. 21, 1997, which is hereby incorporated by reference.

Buffering Agents—Dishwashing compositions of the invention will be subjected to acidic stresses created by food soils when put to use, i.e., diluted and applied to soiled dishes. The compositions of the present invention will preferably have a pH of at least about 8.5, preferably at least about 10, more preferably, at least about 10.5; the compositions of the present invention will also have a pH of no more than about 12, preferably no more than about 11.5, more preferably no more than about 10.9. Because the detergent compositions of the present invention are largely alkaline, the detergent compositions will contain a buffering agent capable of providing a generally more alkaline pH in the composition and in dilute solutions. Dishwashing compositions of the present invention will thus contain from about 0.5% to 15%, preferably from about 1% to 12%, most preferably from about 2% to 10%, by weight, of a buffering agent. The pKa value of this buffering agent should be about 0.5 to 1.0 pH units below the desired pH value of the composition (determined as described above Preferably, the pKa of the buffering agent should be from about 7 to about 12. Under these conditions the buffering agent most effectively controls the pH while using the least amount thereof.

Preferred inorganic buffers/alkalinity sources include the alkali metal carbonates, alkali metal hydroxides and alkali metal phosphates, e.g., sodium carbonate, sodium hydroxide, sodium polyphosphate.

The buffering agent may be an active detergent in its own right, or it may be a low molecular weight, organic or inorganic material that is used in this composition solely for maintaining an alkaline pH. Preferred buffering agents for compositions of this invention are nitrogen-containing materials. Further examples of suitable buffering agents may be found in 7408P.

Optional Detergent Ingredients:

Polymeric Suds Stabilizer—The compositions of the present invention may optionally contain a polymeric suds stabilizer. These polymeric suds stabilizers provide extended suds volume and suds duration without sacrificing the grease cutting ability of the liquid detergent compositions. These polymeric suds stabilizers are selected from:

i) homopolymers of (N,N-dialkylamino)alkyl acrylate esters having the formula:

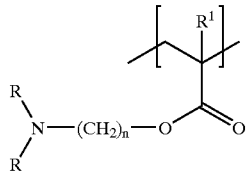

wherein each R is independently hydrogen, $C_1$–$C_8$ alkyl, and mixtures thereof, $R^1$ is hydrogen, $C_1$–$C_6$ alkyl, and mixtures thereof, n is from 2 to about 6; and ii) copolymers of (i) and

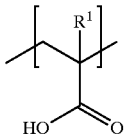

wherein $R^1$ is hydrogen, C1–C6 alkyl, and mixtures thereof, provided that the ratio of (ii) to (i) is from about 2 to 1 to about 1 to 2; The molecular weight of the polymeric suds boosters, determined via conventional gel permeation chromatography, is from about 1,000 to about 2,000,000, preferably from about 5,000 to about 1,000,000, more preferably from about 10,000 to about 750,000, more preferably from about 20,000 to about 500,000, even more preferably from about 35,000 to about 200,000. The polymeric suds stabilizer can optionally be present in the form of a salt, either an inorganic or organic salt, for example the citrate, sulfate, or nitrate salt of (N,N-dimethylamino)alkyl acrylate ester.

One preferred polymeric suds stabilizer is (N,N-dimethylamino)alkyl acrylate esters, namely

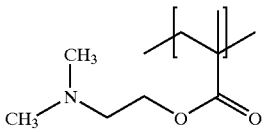

When present in the compositions, the polymeric suds booster may be present in the composition from about 0.01% to about 15%, preferably from about 0.05% to about 10%, more preferably from about 0.1% to about 5%, by weight.

Builder—The compositions according to the present invention may further comprise a builder system. Because builders such as citric acid and citrates impair the stability of enzymes in LDL compositions, it is desirable to include reduce the amounts or completely remove the builder salts normally utilized in LDL compositions incorporating propylene glycol as a builder. When a detergent composition includes propylene glycol solvent as a part or a whole of the detergent's carrier, enzymes are more stable and smaller amounts or no builder salts are needed.

If it is desirable to use a builder, then any conventional builder system is suitable for use herein including aluminosilicate materials, silicates, polycarboxylates and fatty acids, materials such as ethylene-diamine tetraacetate, metal ion sequestrants such as aminopolyphosphonates, particularly ethylenediamine tetramethylene phosphonic acid and diethylene triamine pentamethylene-phosphonic acid. Though less preferred for obvious environmental reasons, phosphate builders can also be used herein.

Suitable polycarboxylates builders for use herein include citric acid, preferably in the form of a water-soluble salt, derivatives of succinic acid of the formula is R—CH(COOH)$CH_2$(COOH) wherein R is $C_{10-20}$ alkyl or alkenyl, preferably $C_{12-16}$, or wherein R can be substituted with hydroxyl, sulfo sulfoxyl or sulfone substituents. Specific examples include lauryl succinate, myristyl succinate, palmityl succinate 2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Especially for the liquid execution herein, suitable fatty acid builders for use herein are saturated or unsaturated $C_{10-18}$ fatty acids, as well as the corresponding soaps. Preferred saturated species have from 12 to 16 carbon atoms in the alkyl chain. The preferred unsaturated fatty acid is oleic acid. Other preferred builder system for liquid compositions is based on dodecenyl succinic acid and citric acid.

If detergency builder salts are included, they will be included in amounts of from 0.5% to 50% by weight of the composition preferably from 5% to 30% and most usually from 5% to 25% by weight.

Enzymes—Detergent compositions of the present invention may further comprise one or more enzymes which provide cleaning performance benefits. Said enzymes include enzymes selected from cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, β-glucanases, arabinosidases or mixtures thereof. A preferred combination is a detergent composition having a cocktail of conventional applicable enzymes like protease, amylase, lipase, cutinase and/or cellulase. Enzymes when present in the compositions, at from about 0.0001% to about 5% of active enzyme by weight of the detergent composition. Preferred proteolytic enzymes, then, are selected from the group consisting of Alcalase® (Novo Industri A/S), BPN', Protease A and Protease B (Genencor), and mixtures thereof. Protease B is most preferred. Preferred amylase enzymes include TERMAMYL®, DURAMYL® and the amylase enzymes those described in WO 9418314 to Genencor International and WO 9402597 to Novo.

Further non-limiting examples of suitable and preferred enzymes are disclosed in the copending application: "Dishwashing Detergent Compositions Containing Organic Diamines for Improved Grease Cleaning, Sudsing, Low temperature stability and Dissolution", having P & G Case No. 7167P and application Ser. No. 60/087,693, which is hereby incorporated by reference.

Because hydrogen peroxide and builders such as citric acid and citrates impair the stability of enzymes in LDL compositions, it is desirable to reduce or eliminate the levels of these compounds in compositions which contain enzymes. Hydrogen peroxide is often found as an impurity in surfactants and surfactant pastes. As such, the preferred level of hydrogen peroxide in the amine oxide or surfactant paste of amine oxide is 0–40 ppm, more preferably 0–15 ppm. Amine impurities in amine oxide and betaines, if present, should be minimized to the levels referred above for hydrogen peroxide and preferably should be less than 1 ppm.

Magnesium Ions

While it is preferred that divalent ions be omitted from LDL compositions prepared according to the present invention, alternate embodiments of the present invention may include magnesium ions.

It is desirable to exclude all divalent ions from the present LDL compositions, because such ions may lead to slower dissolution as well as poor rinsing, and poor low temperature stability properties. Moreover, formulating such divalent ion-containing compositions in alkaline pH matrices may be difficult due to the incompatibility of the divalent ions, particularly magnesium, with hydroxide ions.

Nonetheless, the presence of magnesium ions offers several benefits. Notably, the inclusion of such divalent ions improves the cleaning of greasy soils for various LDL compositions, in particular compositions containing alkyl ethoxy carboxylates and/or polyhydroxy fatty acid amide. This is especially true when the compositions are used in softened water that contains few divalent ions.

But in the present invention, these benefits can be obtained without the inclusion of divalent ions. In particular, improved grease cleaning can be achieved without divalent ions by the inclusion of organic diamines in combination with amphoteric and anionic surfactants in the specific ratios discussed above while enzymes have been shown to improve the skin mildness performance of the present LDL compositions.

If they are to be included in an alternate embodiment of the present LDL compositions, then the magnesium ions are present at an active level of from about 0.01% to 1%, preferably from about 0.015% to 0.5%, more preferably from about 0.025% to 0.1%, by weight. The amount of magnesium ions present in compositions of the invention will be also dependent upon the amount of total surfactant present therein, including the amount of alkyl ethoxy carboxylates and polyhydroxy fatty acid amide.

Preferably, the magnesium ions are added as a hydroxide, chloride, acetate, sulfate, formate, oxide or nitrate salt to the compositions of the present invention. Because during storage, the stability of these compositions becomes poor due to the formation of hydroxide precipitates in the presence of compositions containing moderate concentrations of hydroxide ions, it may be necessary to add certain chelating agents. Suitable chelating agents are discussed further below and in U.S. Pat. No. 5,739,092, issued Apr. 14, 1998, to Ofosu-asante, incorporated herein by reference.

Chelating Agents—The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediaminetriacetates, nitrilo-tri-acetates, ethylenediamine tetrapro-prionates, triethylenetetraaminehexacetates, diethylenetriaminepentaacetates, and ethanoldi-glycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

The compositions herein may also contain water-soluble methyl glycine diacetic acid (MGDA) salts (or acid form) as a chelant or co-builder. Similarly, the so called "weak" builders such as citrate can also be used as chelating agents.

If utilized, these chelating agents will generally comprise from about 0.1% to about 15% by weight of the detergent compositions herein. More preferably, if utilized, the chelating agents will comprise from about 0.1% to about 3.0% by weight of such compositions.

Other Perfumes

In addition to the perfume and fragrance materials mentioned above, the present detergent compositions may also include various other natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise extremely complex mixtures of such ingredients. Further examples of perfume ingredients useful herein can be found in the copending provisional patent application: "Dishwashing Detergent Compositions Containing Organic Diamines for Improved Grease Cleaning, Sudsing, Low temperature stability and Dissolution", having P & G Case No. 7167P, application Ser. No. 60/087,693, incorporated above. It should be noted that these additional ingredients which come under the heading "Other Perfumes" are included in addition to the perfume composition formulations discussed above.

Other Ingredients—The detergent compositions will further preferably comprise one or more detersive adjuncts selected from the following: soil release polymers, polymeric dispersants, polysaccharides, abrasives, bactericides and other antimicrobials, tarnish inhibitors, builders, enzymes, dyes, buffers, antifungal or mildew control agents, insect repellents, perfumes, hydrotropes, thickeners, processing aids, suds boosters, brighteners, anti-corrosive aids, stabilizers antioxidants and chelants. A wide variety of other ingredients useful in detergent compositions can be included in the compositions herein, including other active ingredients, carriers, hydrotropes, antioxidants, processing aids, dyes or pigments, solvents for liquid formulations, solid fillers for bar compositions, etc. If high sudsing is desired, suds boosters such as the $C_{10}$–$C_{1-6}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous.

An antioxidant can be optionally added to the detergent compositions of the present invention. They can be any conventional antioxidant used in detergent compositions, such as 2,6-di-tert-butyl-4-methylphenol (BHT), carbamate, ascorbate, thiosulfate, monoethanolamine(MEA), diethanolamine, triethanolamine, etc. It is preferred that the antioxidant, when present, be present in the composition from about 0.001% to about 5% by weight.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%–5% of $C_{13-15}$ ethoxylated alcohol (EO 7) nonionic surfactant. Typically, the enzyme/surfactant solution is 2.5× the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes, bleaches, bleach activators, bleach catalysts, photoactivators, dyes, fluorescers, fabric conditioners and hydrolyzable surfactants can be "protected" for use in detergents, including liquid laundry detergent compositions.

Further, these hand dishwashing detergent embodiments preferably further comprises a hydrotrope. Suitable hydrotropes include sodium, potassium, ammonium or water-soluble substituted ammonium salts of toluene sulfonic acid, naphthalene sulfonic acid, cumene sulfonic acid, xylene sulfonic acid.

Non-Aqueous Liquid Detergents

The manufacture of liquid detergent compositions which comprise a non-aqueous carrier medium can be prepared according to the disclosures of U.S. Pat. Nos. 4,753,570; 4,767,558; 4,772,413; 4,889,652; 4,892,673; GB-A-2,158,838; GB-A-2,195,125; GB-A-2,195,649; U.S. Pat. No. 4,988,462; U.S. Pat. No. 5,266,233; EP-A-225,654 (Jun. 16, 1987); EP-A-510,762 (Oct. 28, 1992); EP-A-540,089 (May 5, 1993); EP-A-540,090 (May 5, 1993); U.S. Pat. No. 4,615,820; EP-A-565,017 (Oct. 13, 1993); EP-A-030,096 (Jun. 10, 1981), incorporated herein by reference. Such compositions can contain various particulate detersive ingredients stably suspended therein. Such non-aqueous compositions thus comprise a LIQUID PHASE and, optionally but preferably, a SOLID PHASE, all as described in more detail hereinafter and in the cited references.

The compositions of this invention can be used to form aqueous washing solutions for use hand dishwashing. Generally, an effective amount of such compositions is added to water to form such aqueous cleaning or soaking solutions.

The aqueous solution so formed is then contacted with the dishware, tableware, and cooking utensils.

An effective amount of the detergent compositions herein added to water to form aqueous cleaning solutions can comprise amounts sufficient to form from about 500 to 20,000 ppm of composition in aqueous solution. More preferably, from about 800 to 5,000 ppm of the detergent compositions herein will be provided in aqueous cleaning liquor.

The following examples are illustrative of the present invention, but are not meant to limit or otherwise define its scope. All parts, percentages and ratios used herein are expressed as percent weight unless otherwise specified.

EXAMPLES

TABLE I

Light Duty Liquid dishwashing detergents of the present invention are as follows:

| | Example 1 | Example 2 | Example 3 | Example 4 |
|---|---|---|---|---|
| AE0.6S[1] | 26.09 | 26.09 | 26.09 | 28.80 |
| Amine oxide[2] | 6.50 | 6.5 | 8.0 | 8.0 |
| Suds boosting polymer[3] | 0.20 | 0.20 | 0.20 | 0.22 |
| Sodium Cumene Sulfonate | 3.50 | 3.50 | 3.50 | 3.90 |
| Nonionic[4] | 3.00 | 3.00 | 3.00 | 3.30 |
| Diamine[5] | 0.50 | 0.50 | 0.50 | 0.55 |
| Sodium Chloride | 1.5 | 1.5 | 1.5 | 1.5 |
| NaOH | 0.35 | 0.35 | 0.35 | 0.35 |
| $Na_2CO_3$ | 1.75 | 1.75 | 1.75 | 1.75 |
| $K_2CO_3$ | 0.75 | 0.75 | 0.75 | 0.75 |
| propylene glycol | 4.0 | 4.0 | 4.0 | 4.0 |
| polypropylene glycol | 1.0 | 1.0 | 1.0 | 1.0 |
| Ethanol | 3.0 | 0.7 | 0.7 | — |
| Perfume[6] Composition | 0.05 | 0.05 | 0.05 | 0.05 |
| Water and Misc. | BAL. | BAL. | BAL. | BAL. |
| Viscosity (cps @ 70F) | 353 | 640 | 635 | 848 |
| pH @ 10% | 10.8 | 10.8 | 10.8 | 10.8 |

[1]C12–13 alkyl ethoxy sulfonate containing an average of 0.6 ethoxy groups.
[2]$C_{12}$–$C_{14}$ Amine oxide.
[3]Polymer is (N,N-dimethylamino)ethyl methacrylate homopolymer
[4]Nonionic may be either C10 Alkyl ethoxylated surfactant containing 8 ethoxy groups or C10 Alkyl ethoxylated surfactant containing 8 ethoxy groups.
[5]1,3 bis(methylamine)-cyclohexane
[6]The perfume Composition is that described in table IV.

TABLE II

A light duty liquid dishwashing detergent of the present invention is as follows:

| | Example 5 | Example 6 | Example 7 |
|---|---|---|---|
| AE(1–3)S[1] | 31.0 | 34.0 | 31.0 |
| Amine oxide | 5.0 | 5.0 | 4.0 |
| $C_{12-14}$ Glucose Amide | 4.0 | 4.0 | 4.0 |
| EO/PO Block Copolymer | 0.4 | 0.3 | 0.4 |
| Sodium Chloride | — | 4.0 | — |
| Sodium Xylene Sulfonate | 5.0 | 5.0 | 5.0 |
| Nonionic[2] | 1.0 | 1.0 | 1.0 |
| $Na_2CO_3$ | — | 3.0 | |
| KCl | 2.5 | — | 2.5 |
| $K_2CO_3$ | 3.0 | — | 2.5 |
| Ethanol | 5.0 | 7.0 | 5.0 |
| Viscosity Thickener | 1.0 | — | — |
| Perfume Composition[3] | 0.05 | 0.05 | 0.05 |
| Other Perfumes | 0.2 | 0.2 | 0.2 |

TABLE II-continued

A light duty liquid dishwashing detergent of the present invention is as follows:

| | Example 5 | Example 6 | Example 7 |
|---|---|---|---|
| Water and Misc. | BAL. | BAL. | BAL. |
| PH @ 10% | 10.3 | 10.1 | 10.5 |

[1]C12–13 sodium alkyl ethoxy sulfonate containing an average of 1 to 3 ethoxy groups.
[2]Nonionic may be either C10 Alkyl ethoxylated surfactant containing 8 ethoxy groups or C10 Alkyl ethoxylated surfactant containing 8 ethoxy groups.
[3]The perfume Composition is that described in table IV.

TABLE III

A light duty liquid dishwashing detergent of the present invention is as follows:

| | Example 8 |
|---|---|
| AE0.6S[1] | 26.1 |
| Amine oxide[2] | 6.5 |
| Citric acid | 2.6 |
| Suds boosting polymer[3] | 0.2 |
| Sodium Cumene Sulfonate | 3.50 |
| propylene glycol | 9.8 |
| NonionicC11E9[4] | 3.0 |
| Diamine[5] | 0.50 |
| Perfume Composition[6] | 0.05 |
| Water | BAL. |
| Total Active | 36% |
| Viscosity (cps @ 20° C.) | 780 |
| pH @ 10% | 9.0 |

[1]C12–13 alkyl ethoxy sulfonate containing an average of 0.6 ethoxy groups.
[2]$C_{12}$–$C_{14}$ Amine oxide.
[3]Polymer is (N,N-dimethylamino)ethyl methacrylate homopolymer
[4]Nonionic may be either C11 Alkyl ethoxylated surfactant containing 9 ethoxy groups or C10 Alkyl ethoxylated surfactant containing 8 ethoxy groups..
[5]1,3 bis(methylamine)-cyclohexane.
[6]The perfume Composition is that described in table IV.

TABLE IV

A perfume composition of the present invention is as follows:

| Fragrance Material | Weight % |
|---|---|
| benzyl acetate | 28.09 |
| ethyl-2-methyl butyrate | 0.70 |
| ortho tertiary butyl cyclohexanyl acetate | 14.04 |
| para-Ethyl-alpha, alpha-Dimethyl Hydrocinnamaldehyde | 0.28 |
| P. T. Bucinal | 42.13 |
| 3-Cyclohexane-1-Carboxaldehyde, 4-(4-Hydroxy-4-Methyl Pentyl) | 14.04 |
| Watermint | 0.70 |

What is claimed is:

1. A liquid dishwashing detergent composition suitable for use in hand dishwashing, the composition comprising:

(a) an anionic surfactant;

(b) a solvent;

(c) a Schiff base comprising the reaction product of an aldehyde with a diamine which is a member selected from the group consisting of 1,3-bis(methylamine)

cyclohexane, 1,3-propane diamine, 1,6-hexane diamine 1,3-pentane diamine and 2-methyl 1,5 pentane diamine.

2. The liquid dishwashing detergent composition according to claim 1, wherein the aldehyde is a member selected from the group consisting of para-tertiary-butyl-alpha-methyl hydrocinnamic aldehyde, 4,4-methyl-hydroxyamyl)-3-cyclohexane-1-carboxyaldehyde, 4,4(hydroxy-4-methyl-pentyl) hydroxycitronellal, and alpha-methyl-beta-3,4-methylenedioxy-phenyl propionaldehyde.

3. The liquid dishwashing detergent composition according to claim 1 wherein the detergent composition comprises less than 0.5% of hydrogen peroxide.

4. The liquid dishwashing detergent composition according to claim 1, wherein the anionic surfactant and diamine are in a mole ratio greater than about 9:1.

5. The liquid dishwashing detergent composition according to claim 1, wherein the detergent composition further comprises an amphoteric surfactant.

6. The liquid dishwashing detergent composition according to claim 5, wherein the detergent composition comprises from about 0.1% to about 20% by weight of the amphoteric surfactant.

7. The liquid dishwashing detergent composition according to claim 6, wherein the anionic surfactant, amphoteric surfactant and diamine are in a mole ratio from about 10:40:1 to about 9:0:5:1.

* * * * *